US007883082B2

(12) United States Patent
Asada

(10) Patent No.: US 7,883,082 B2
(45) Date of Patent: Feb. 8, 2011

(54) SHEET FEED DEVICES AND IMAGE RECORDING APPARATUS COMPRISING SUCH SHEET FEED DEVICES

(75) Inventor: Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 39 days.

(21) Appl. No.: 12/191,404

(22) Filed: Aug. 14, 2008

(65) Prior Publication Data

US 2009/0140484 A1 Jun. 4, 2009

(30) Foreign Application Priority Data

Nov. 30, 2007 (JP) ..... 2007-311607

(51) Int. Cl.
*B65H 3/44* (2006.01)

(52) U.S. Cl. ..... 271/9.11; 271/9.08; 271/9.07

(58) Field of Classification Search ..... 271/9.01, 271/9.07, 9.08, 9.09, 9.11
See application file for complete search history.

(56) References Cited

U.S. PATENT DOCUMENTS 5,346,197 A * 9/1994 Takano et al. ..... 271/9.05
5,737,682 A * 4/1998 Yamagishi ..... 399/402
7,543,809 B2 * 6/2009 Shiohara ..... 271/9.11
2006/0163796 A1 * 7/2006 Shiohara et al. ..... 271/9.01
2007/0075477 A1 * 4/2007 Shiohara ..... 271/9.08
2007/0201921 A1 * 8/2007 Asada et al. ..... 399/393

FOREIGN PATENT DOCUMENTS

JP 2007223786 A 9/2007

* cited by examiner

*Primary Examiner*—Kaitlin S Joerger
(74) *Attorney, Agent, or Firm*—Baker Botts L.L.P.

(57) ABSTRACT

A sheet feed device includes a first tray comprising a first plate configured to receive a first plurality of sheets thereon, in which the first tray includes a support, and a second tray positioned on the first tray. The second tray includes a first and a second side portion, and a second plate configured to receive a second plurality of sheets thereon. The device also includes a feed roller configured to selectively feed the sheets in a sheet feed direction. The support is configured to selectively support the second tray at a retracted position and a sheet feed position at which the feed roller is configured to selectively feed the first plurality of sheets and the second plurality of sheets, respectively. Moreover, a shortest distance between an upper surface of the first plate and a lower surface of the second plate when the second tray is in the sheet feed position is less than a shortest distance in the retracted position.

15 Claims, 11 Drawing Sheets

SHEET FEED DEVICES AND IMAGE RECORDING APPARATUS COMPRISING SUCH SHEET FEED DEVICES

CROSS REFERENCE TO RELATED APPLICATIONS

The present application claims priority from Japanese Patent Application No. 2007-311607, which was filed on Nov. 30, 2007, the disclosure of which is incorporated herein by reference in its entirety.

BACKGROUND OF THE INVENTION

1. Field of the Invention

The present invention relates generally to sheet feed devices which comprise a first tray and a second tray positioned on the first tray, and are configured to increase the capacity of the first tray without increasing the height of the sheet feed device, and to image recording apparatus which comprise, such a sheet feed device.

2. Description of Related Art

A known sheet feed device, such as the sheet feed device described in Japanese Laid-Open Patent Application Publication No. 2007-223786, is used in a known image recording apparatus, such as a printer or a facsimile device, or both. The known sheet feed device includes a first tray for storing a plurality of sheets having a first size, and a second tray for storing at least one sheet having a second size which is smaller than the first size. The second tray, which is thinner than the first tray, is positioned on the first tray, such that the second tray is selectively advanced or retracted with respect to a sheet feed direction. When the second tray is retracted upstream in the sheet feed direction, a feed roller applies a force on the sheets in the first tray. The feed roller cooperates with a separation member positioned at a downstream end of the first tray to separate and feed an uppermost sheet to a recording unit via a U-shaped path. When the second tray is advanced downstream in the sheet feed direction, the feed roller applies a force on the sheets in the second tray.

The second tray is supported on its opposed sides, which extend in the sheet feed direction, by rails formed on upper surfaces of opposed side plates of the first tray, such that the second tray may slide on the first tray. When the feed roller feeds the sheets from the second tray, a downstream end of the second tray is supported by the separation member.

The feed roller is positioned at a free end of an arm, and a base end of the arm is pivotably attached to a drive shaft. As an angle of inclination of the arm with respect to an upper surface of the sheets decreases, a contact force applied by the feed roller on the sheets decreases, such that a sheet drawing force associated with the feed roller also decrease, which may result in an idle rotation of the feed roller, i e., a failure to feed a sheet. The angle of inclination of the arm is formed between an upper surface of the sheets and a line which connects a point at which the feed roller contacts the upper surface of the sheets and the pivot center of the arm.

In order to increase the maximum number of sheets which may be stored in the first tray, the height of the first tray may be increased. For example, the height of the first tray may be increased by about 5 mm in order to increase the capacity of the first tray from 100 sheets to 150 sheets. In this case, if the diameter of the feed roller, the length of the arm, the mounting height of the drive shaft, and the mounting height of the first tray are not altered, the angle of the arm with respect to the upper surface of the sheets on the second tray decreases.

In order to prevent a sheet feeding failure from the second tray, the mounting position of the feed unit including the arm and the feed roller may be raised, resulting in an increase in the height of the image recording apparatus. Thus, increasing the capacity of the first tray also may require modifying parts of the image recording apparatus other than the first tray and the second tray, e., may require modifying parts which have a relatively small height.

SUMMARY OF THE INVENTION

Therefore, a need has arisen for sheet feed devices and image recording apparatus that overcome these and other shortcomings of the related art. A technical advantage of the present invention is that the maximum capacity of the first tray may be increased, and the sheets from the second tray may be fed reliably, without increasing the height of the sheet feed device.

According to an embodiment of the present invention, a sheet feed device comprises a first tray comprising a first plate configured to receive a first plurality of sheets thereon, in which the first tray comprises a support, and a second tray positioned on the first tray. The second tray comprises a first side portion, a second side portion which opposes the first side portion, and a second plate configured to receive a second plurality of sheets thereon. The device also comprises a feed roller configured to selectively feed the first plurality of sheets and the second plurality of sheets in a sheet feed direction toward a sheet feed path. The first side portion and the second side portion extend along the sheet feed direction, and the support is configured to support the first side portion and the second side portion. The support is further configured to selectively support the second tray in a retracted position in which the feed roller is configured to selectively feed the first plurality of sheets and in a sheet feed position in which the feed roller is configured to selectively feed the second plurality of sheets. Moreover, a shortest distance between an upper surface of the first plate and a lower surface of the second plate when the second tray is in the sheet feed position is less than a shortest distance between the upper surface of the first plate and the lower surface of the second plate when the second tray is in the retracted position.

According to another embodiment of the present invention, an image forming apparatus comprises a sheet feed device. The sheet feed device comprises a first tray comprising a first plate configured to receive a first plurality of sheets thereon, in which the first tray comprises a support, and a second tray positioned on the first tray. The second tray comprises a first side portion, a second side portion which opposes the first side portion, and a second plate configured to receive a second plurality of sheets thereon. The device also comprises a feed roller configured to selectively feed the first plurality of sheets and the second plurality of sheets in a sheet feed direction toward a sheet feed path. The first side portion and the second side portion extend along the sheet feed direction, and the support is configured to support the first side portion and the second side portion. The support is further configured to selectively support the second tray in a retracted position in which the feed roller is configured to selectively feed the first plurality of sheets and in a sheet feed position in which the feed roller is configured to selectively feed the second plurality of sheets. Moreover, a shortest distance between an upper surface of the first plate and a lower surface of the second plate when the second tray is in the sheet feed position is less than a shortest distance between the upper surface of the first plate and the lower surface of the second plate when the second tray is in the retracted position. The image forming apparatus also comprises a housing, and a recording unit configured to receive the first plurality of sheets and the second plurality of sheets from the feed roller via the sheet feed path, and to record an image on the first plurality of sheets and the second plurality of sheets received from the feed roller. Moreover, the recording unit and the sheet feed device are positioned within the housing, the sheet feed path is formed in the housing, and the first tray and the second tray are configured to be selectively inserted into and removed from the housing.

Other advantages of the present invention will be apparent to persons of ordinary skill in the art in view of the following detailed description of the invention and the accompanying drawings.

BRIEF DESCRIPTION OF THE DRAWINGS

For a more complete understanding of the present invention, and the needs satisfied thereby, reference now is made to the following descriptions taken in connection with the accompanying drawings.

DETAILED DESCRIPTION OF EMBODIMENTS

Embodiments of the present invention may be understood by referring to FIGS. 1-11, like numerals being used for like corresponding parts in the various drawings.

Figure 1:
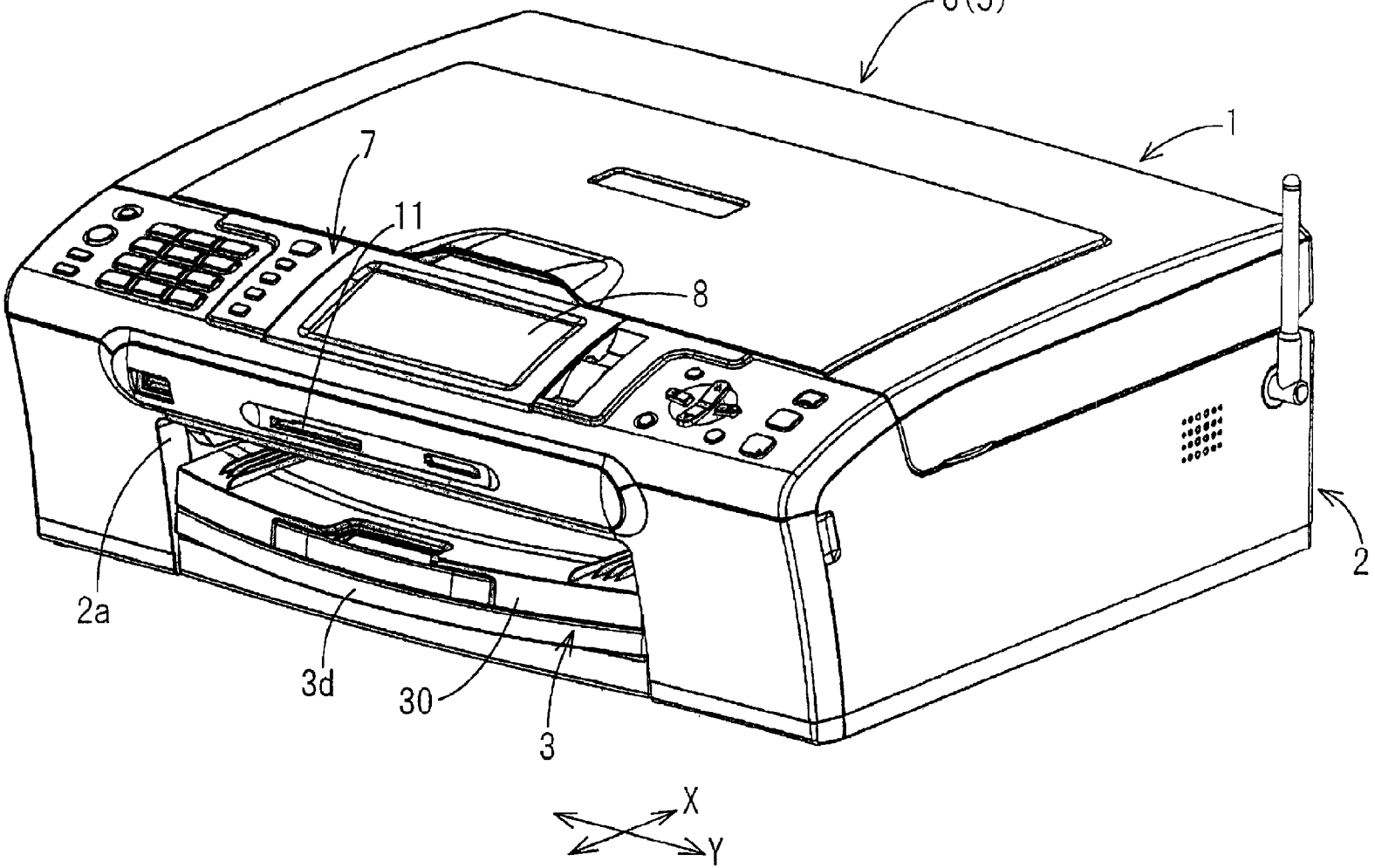
FIG. 1 is a perspective view of an image recording apparatus, according to an embodiment of the present invention.

FIG. 1 shows an image recording apparatus 1 according to an embodiment of the present invention. Image recording apparatus 1 may be a multi-function device (MFD) that has printing, copying, scanning, or facsimile functions, or any combination thereof. As shown in FIG. 1, the image recording apparatus 1 may comprise a housing 2. An opening 2*a* may be formed in the front of the housing 2. A first tray 3 and a second tray 30 positioned on the first tray 3 may be mounted in the opening 2*a*, such that they may be selectively inserted into and removed from the opening 2*a* in an X-axis direction. Hereinafter, a side on which the opening 2*a* is located is referred to as a "front" side of the image recording apparatus 1, and a side opposite the opening 2*a* is referred to as a "rear" side of the image recording apparatus 1.

An image reading device 5 may be positioned, on an upper portion of the housing 2, for reading a document during a copying and/or a facsimile operation of the image recording apparatus 1. The image reading device 5 may be vertically pivotable about a pivot located at one end of the housing 2. A glass plate may be positioned at the top of the image reading device 5, and may be covered by a document cover 6 which may be vertically pivotable about a pivot located at a rear end of the image reading device 5. A document may be positioned on the glass plate by opening the document cover 6 upward. A scanner, e.g., a contact image sensor, may read an image of the document while reciprocating under the glass plate in a main scanning direction, e.g., a Y-axis direction.

An operation panel 7 may be positioned at the top of the housing 2, on a front side of the image reading device 5, and may comprise a plurality of operation buttons and a display device 8, e.g., a liquid crystal display. The operation buttons may comprise a start button (not shown) and a stop button (not shown), which may be selected to execute various operations. The display device 8 may display setting conditions of the image recording apparatus 1 and operation messages.

A memory slot 11 for receiving external memories may be positioned at the front of the housing 2, on an upper side of the opening 2*a*. The external memories may be, for example, a Compact Flash®, a Smart Media®, a Memory Stick®, a SD card®, and/or a xD card®. Data stored in an external memory inserted in the memory slot 11 may be read into an internal memory of the image recording device 1, and may be printed on a sheet by a recording unit 10.

Figure 2:
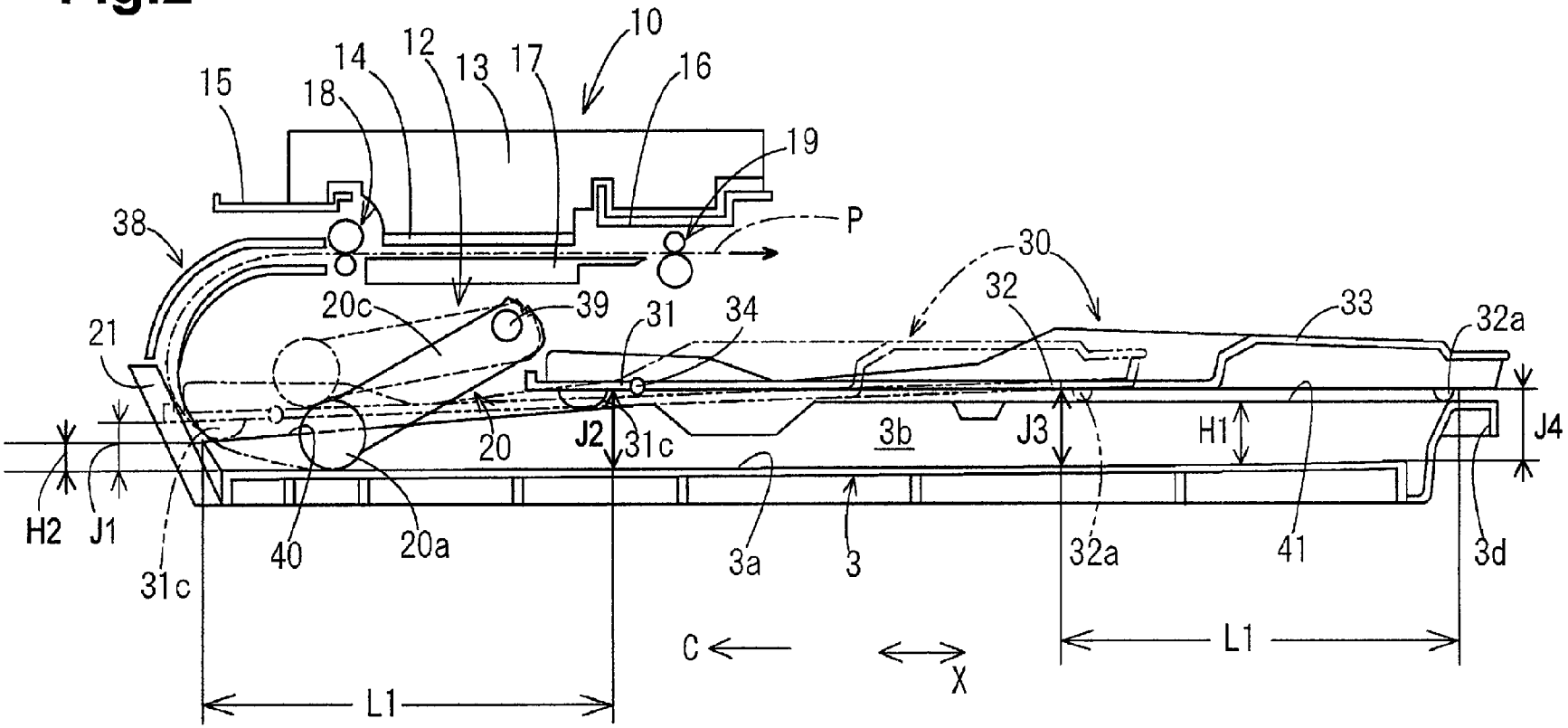
FIG. 2 is a side, cross-sectional view of a sheet feed device, according to an embodiment of the present invention, in which a second tray of the sheet feed device is in a retracted position.

As shown in FIG. 2, the recording unit 10 may be defined by a main frame (not shown) having an upwardly open box structure, and a first guide member 15 and a second guide member 16 which comprise elongate plates which are supported by side plates of the main frame and extend in the main scanning direction. A carriage 13, on which a recording head 14 of the recording unit 10 may be mounted, may be supported by the first guide member 15 located upstream of the carriage 13 in a sheet discharge direction (indicated by arrow B) and the second guide member 16 located downstream of the carriage 13, such that the carriage 13 may be slidably movable on the first guide member 15 and the second guide member 16. Thus, the carriage 13 may be reciprocally movable in the Y-axis direction.

In order to reciprocally move the carriage 13, a timing belt (not shown) may be positioned on an upper surface of the second guide member 16. The timing belt extends in the Y-axis direction and may be wound around pulleys (not shown). A carriage motor (not shown) configured to drive the timing belt may be fixed to a lower surface of the second guide member 16.

A platen 17 may have a flat shape and may extend in the Y-axis direction to face an underside of the recording head 14 on the carriage 13. The platen 17 may be fixed above a bottom plate of the main frame between the first guide member 15 and the second guide member 16.

As shown in FIG. 2, a pair of register rollers (convey rollers) 18 may be positioned upstream of the platen 17 in the sheet discharge direction to feed the sheet P (P1) to the underside of recording head 14, and a pair of discharge rollers 19 may be positioned downstream of the platen 17 to discharge the printed sheet P (P1) to a discharged sheet receiver 33 positioned at an upper surface of the second tray 30. The platen 17 supports the sheet P (P1) conveyed by the register rollers 18, such that a distance between the sheet P (P1) and the recording head 14 may be maintained constant.

Referring to FIG. 2, a sheet feed device 12 according to an embodiment of the present invention is depicted. In sheet feed device 12, the first tray 3 and the second tray 30 may be positioned in two layers in the front opening 2*a* of the image recording apparatus 1. The first tray 3 may comprise a first storing portion 3*b*. A plurality of sheets P, e.g., A4-sized sheets, may be stored in the first storing portion 3*b* with their longer sides extending in the X-axis direction and their shorter sides extending in the Y-axis direction. Thus, the X-axis dimension of the first tray 3 may be longer than the Y-axis dimension thereof. A pendulum-type feed unit 20 sequentially feeds sheets P one at a time from the first tray 3.

As shown in FIGS. 2-5, a main body of the first tray 3 may comprise a synthetic resin formed by injection molding, and may comprise a bottom plate 3*a*, opposed side plates 3*c* extending in the X-axis direction, a handle portion 3*d*, and an inclined separation plate 21 positioned at an downstream end of the main body in a sheet feed direction (indicated by arrow C in FIG. 2). The bottom plate 3*a* may function as a sheet placement plate for positioning the sheets P thereon. The maximum capacity of the first storing portion 3*b* may be about 150 sheets of plain paper, or a stack of sheets having a height of about 15 mm.

The second tray 30 may be supported by a support, such that the second tray 30 may be configured to selectively move upstream and downstream on the first tray 3 in the sheet feed direction between a retracted position and a sheet feed position. When the second tray 30 moves upstream in the sheet feed direction to the retracted position, the feed unit 20 may be allowed to feed the sheets P on the first tray 3. When the second tray 30 moves downstream in the sheet feed direction to the sheet feed position, the feed unit 20 may be allowed to feed the sheets P1 on the second tray 30.

As shown in FIGS. 2-6, the support for supporting opposed sides of a lower surface of the second tray 30 may comprise a first guide rail 41 and a second guide rail 40 which may be integral with each of the opposed side plates 3*c* of the first tray 3. The first guide rail 41, which functions as a first support portion, and a second guide rail 40, which functions as a second support portion, may be positioned upstream and downstream, respectively, of each of the opposed side plates 3*c* in the sheet feed direction and may extend along each of the opposed side plates 3*c*. The second guide rail 40 may be formed along an inner side surface of each of the opposed side plates 3*c*. An upper surface of the second guide rail 40 may be slanted downward toward the inclined separation plate 21. The first guide rail 41 may be formed on an upper surface of each of the opposed side plates 3*c*. The upper surface of the first guide rail 41 may be substantially parallel with the bottom plate 3*a*, and the height of the upper surface of the upstream guide 41 may not be altered.

As shown in FIG. 2, the length along which the second guide rail 40 extends in the sheet feed direction corresponds to a length L1, e.g., about 90 mm, along which the second tray 30 moves between the sheet feed position and the retracted position. When the second tray 30 is in the sheet feed position, a downstream end of the second tray 30 in the sheet feed direction may be positioned closest to the inclined separation plate 21 of the first tray 3. When the second tray 30 is in the retracted position, the downstream end of the second tray 30 may be retracted upstream from a sheet feed roller 20*a* of the feed unit 20. The length along which the first guide rail 41 extends also may correspond to the length L1. The side plate 3*c* may connect an upstream end of the second guide rail 40 and a downstream end of the first guide rail 41.

When the second tray 30 is in the retracted position, an upstream end of the second tray 30 in the sheet feed direction may be located above the handle portion 3*d*.

A height H1 from the bottom plate 3*a* to the upper surface of the first guide rail 40, e.g., about 152 mm, may be selected, such that when a maximum number of plain sheets P, e.g., about 150 plain sheets P, is stored in the first storing portion 3*b* of the first tray 3, a lower surface of the second tray 30 (bottom plate 30*a*) located in the retracted position does not contact an uppermost surface of the sheets P.

The height from the bottom plate 3*a* to the upper surface of the second guide rail 40 may vary, and may be a minimum height H2 at a downstream end of the second guide rail 40. The minimum height H2, e.g., about 112 mm, may be selected, such that the lower surface of the second tray 30 (bottom plate 30*a*) located in the sheet feed position does not contact an uppermost surface of 100 plain sheets stored in the first storing portion 3*b*.

Figure 3:
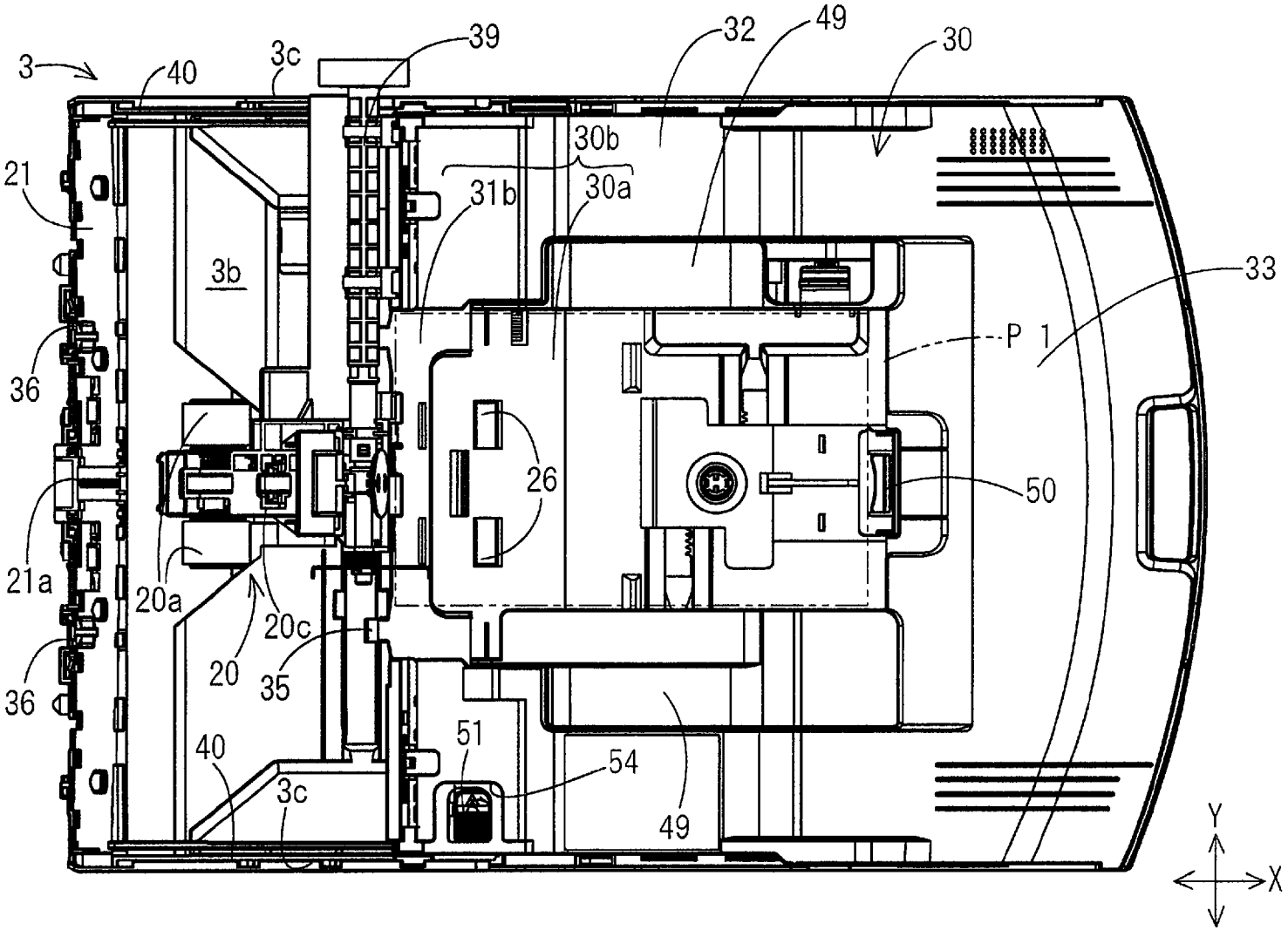
FIG. 3 is a plan view of the sheet feed device of FIG. 2 when the second tray is in the retracted position.
Figure 5:
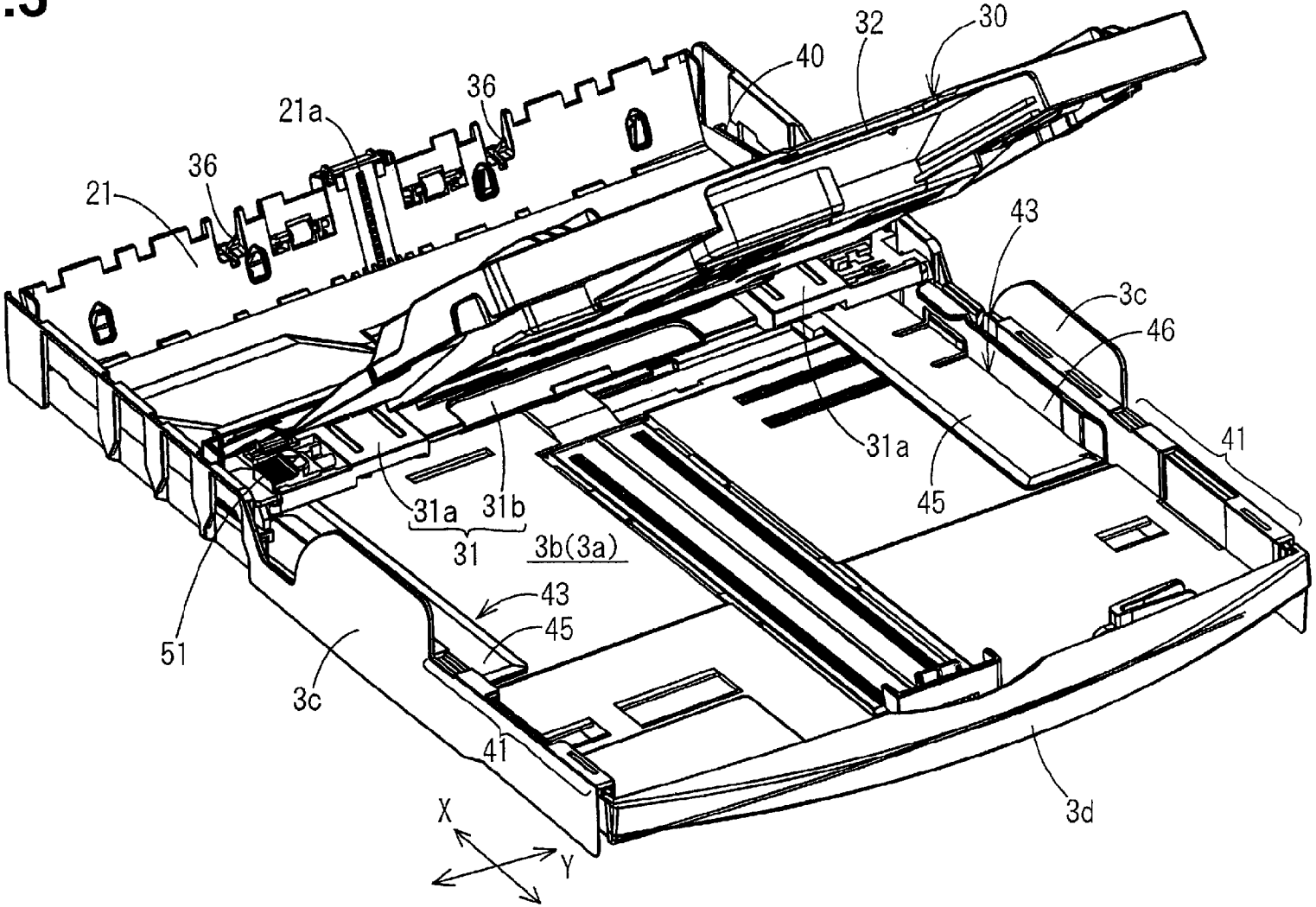
FIG. 5 is a perspective view of the first tray and the second tray when the second tray is in the retracted position and a movable portion of the second tray is pivoted upward.
Figure 6:
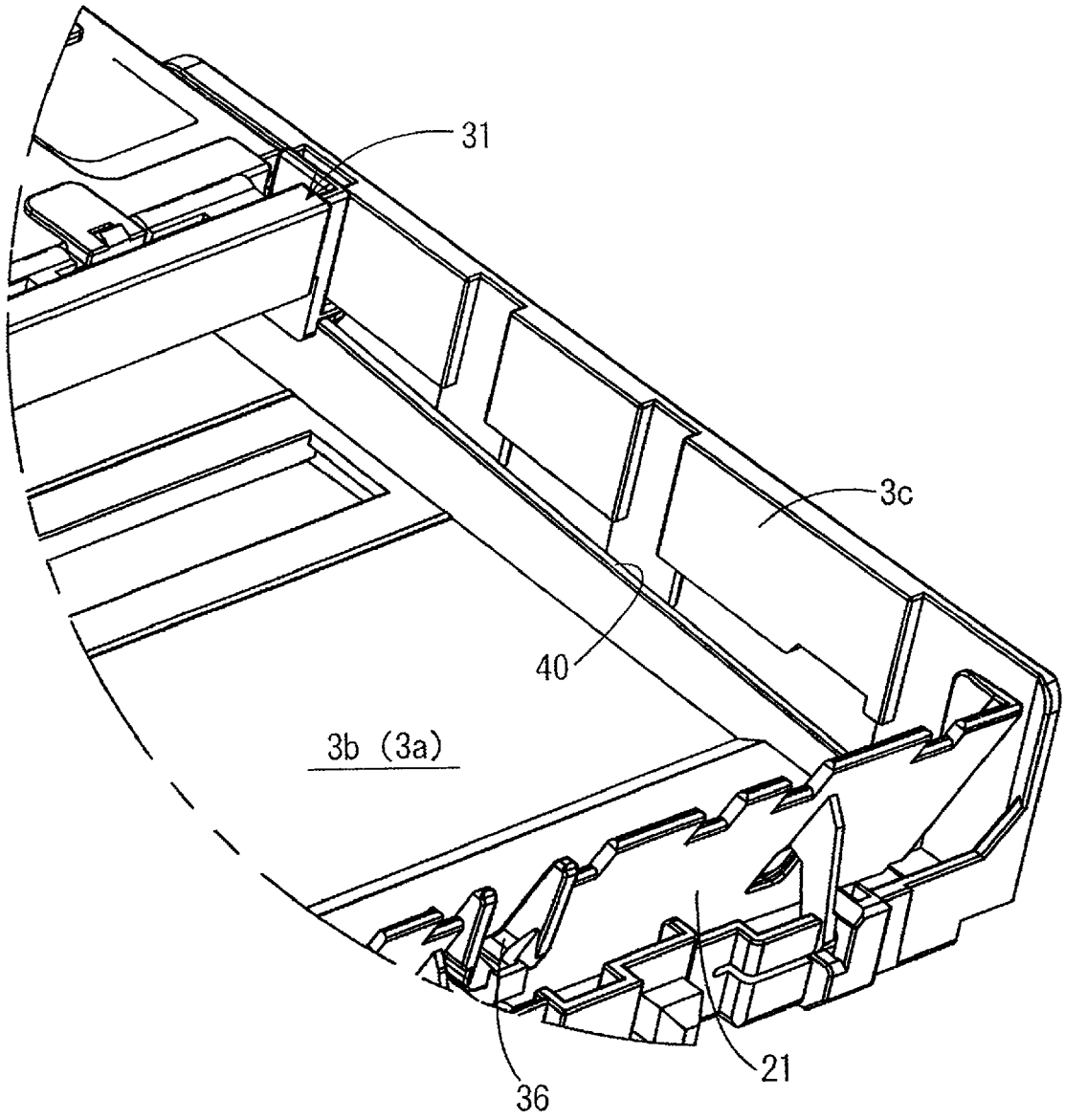
FIG. 6 is a partially cut-out, perspective view of an end of the first tray when the second tray is in the retracted position.

The second tray 30 may comprise a synthetic resin formed by injection molding, and may comprise a sliding portion 31 positioned upstream and a movable portion 32. The movable portion 32 may be connected to the sliding portion 31, and may be vertically pivotable between a horizontal position (as shown in FIG. 3) and a slanted position (as shown in FIG. 5). The sliding portion 31 may comprise a base portion 31*a* on its each side in the Y-axis direction, and a plate portion 31*b* which is connected to the base portions 31*a*. A first contact portion 32*a* may be integral with a lower surface of each side (in the Y-axis direction) of the movable portion 32, and may project from the lower surface. The movable portion 32 may be slidable in the X-axis direction with the first contact portions 32*a* positioned on the first guide rails 41. A second contact portion 31*c* may be integral with a lower surface of each of the base portions 31*a*, and may project from the lower surface. The sliding portion 31 may be slidable in the X-axis direction with the second contact portions 31*c* positioned on the second guide rails 40. On each of the opposed side plates 3*c*, the first contact portion 32*a* may be supported by an upstream end of the first guide rail 41 when the second tray 30 is in the retracted position, and may be supported by a downstream end of the first guide rail 41 when the second tray 30 is in the sheet feed position. The second contact portion 31*c* may be supported by an upstream end of the second guide rail 40 when the second tray 30 is in the retracted position, and may be supported by a downstream end of the second guide rail 40 when the second tray 30 is in the sheet feed position. The first contact portion 32*a* and the second contact portion 31*c* slide on the upper surface of the first guide rail 41 and the upper surface of the second guide rail 40, respectively, when the second tray 30 moves between the retracted position and the sheet feed position.

As described above, the first tray 3 and the second tray 30 each comprise two side portions. Each side portion of the second tray 30 comprises two contact portions. Each side portion of the first tray 3 comprises two support portions which are configured to support the two contact portions, respectively. Each support portion comprises an upstream portion and a downstream portion. Thus, in this embodiment, there may be four side portions, four contact portions, four support portions, four upstream portions, and four downstream portions.

In FIG. 2, distances J1 and J3 indicate distances from an upper surface of the bottom plate 3*a* to a lower surface of the bottom plate 30*a* measured at the downstream end of the second guide rail 40 and the downstream end of the first guide rail 41, respectively, when the second tray 30 is in the sheet feed position. Distances J2 and J4 indicate distances from the upper surface of the bottom plate 3*a* to the lower surface of the bottom plate 30*a* measured at the upstream end of the second guide rail 40 and the upstream end of the first guide rail 41, respectively, when the second tray 30 is in the retracted position. In this embodiment, the distance J1 may be less than the distance J2, the distance J2 may be equal to the distance J4, and the distance J3 may be equal to the distance J4.

As such, the shortest distance from the upper surface of the bottom plate 3*a* of the first tray 3 to the lower surface of the bottom plate 30*a* of the second tray 30 when the second tray 30 is in the sheet feed position may be less than the shortest distance from the upper surface of the bottom plate 3*a* of the first tray 3 to the lower surface of the bottom plate 30*a* of the second tray 30 when the second tray 30 is in the retracted position.

Figure 7:
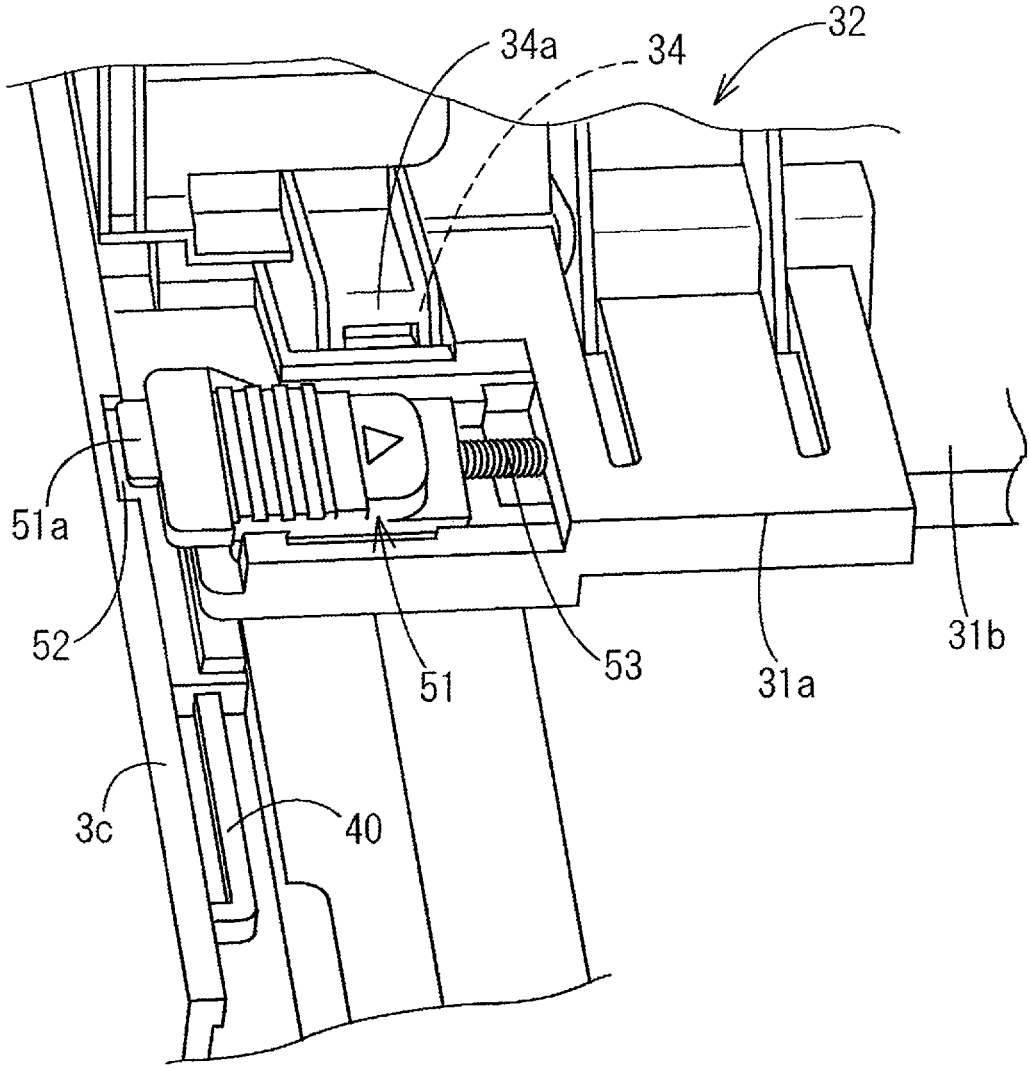
FIG. 7 is a perspective view of a locking mechanism of the second tray.
Figure 8:
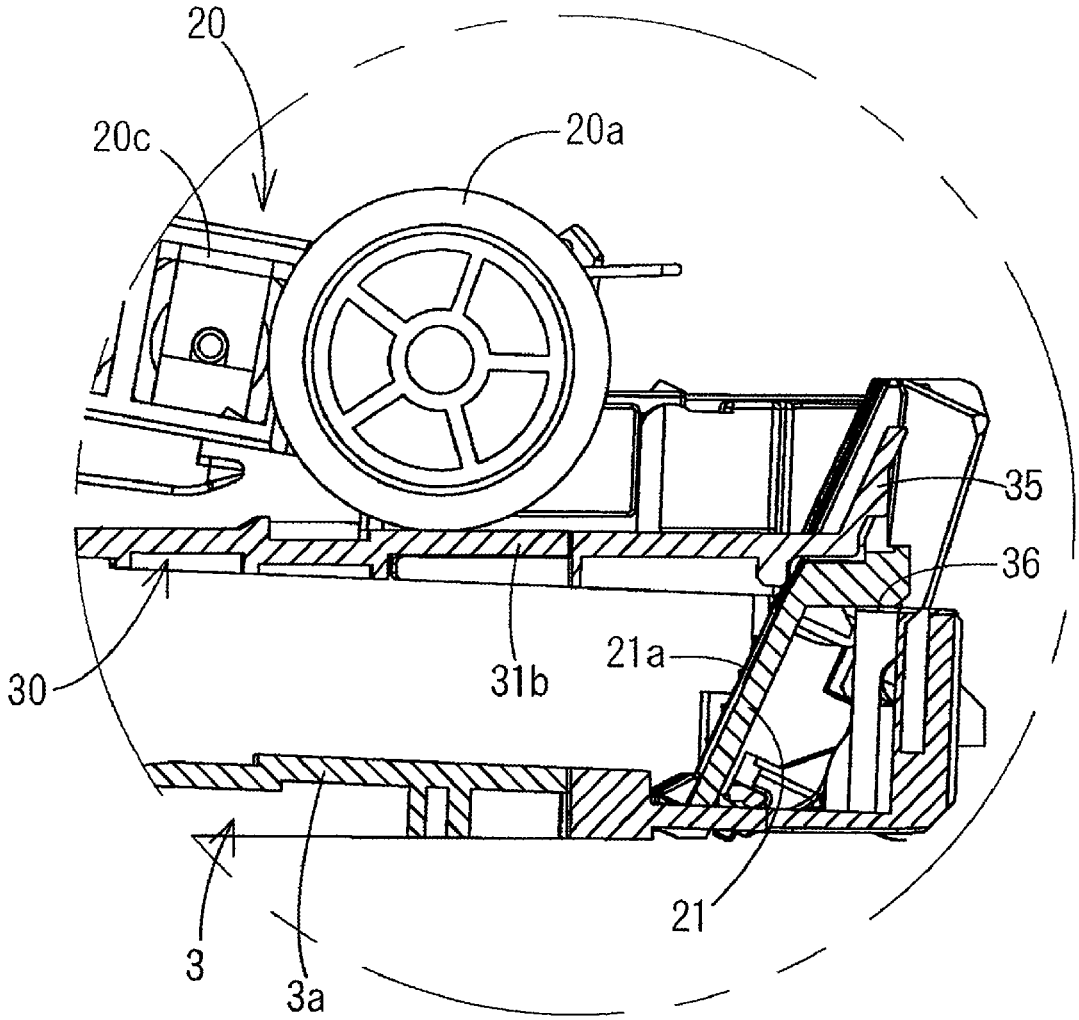
FIG. 8 is a side, cross-sectional view of an end of the second tray when the second tray is in a sheet feed position on the first tray.

As shown in FIGS. 2 and 7, a hinge 34 may be positioned on each side (in the Y-axis direction) of a downstream end of the movable portion 32. A bearing 34*a* may be positioned on each side (in the Y-axis direction) of an upper portion of the sliding portion 31. The hinges 34 may be pivotably fitted into the bearings 34*a*, such that the movable portion 32 may be vertically pivotable. As shown in FIGS. 3 and 8, a projection 35 may be integral with and extend from each side (in the Y-axis direction) of the sliding portion 31, and may project from a downstream end of the sliding portion 31. When the second tray 30 moves downstream in the sheet feed direction (indicated by arrow C in FIGS. 2 and 9) to the sheet feed position, the projections 35 may be fitted into grooves 36 in the inclined separation panel 21. The grooves 36 may function as an auxiliary support which bears the load of the second tray 30 and as a positioning member which positions the second tray 30 in a fixed position.

The sliding portion 31 may be configured to be pivotable via the hinge 34 with respect to the movable portion 32. In this case, as the second tray 30 is advanced along the slanted surface of the second guide rail 40 toward the sheet feed position, the upper surface of the sliding portion 31 is oriented horizontal.

The second tray 30 may be positioned above the first storing portion 3*b* of the first tray 3, and may be movable in the X-axis direction with respect to the first tray 3 and the feed unit 20. As shown in FIG. 3, one or more sheets P1 having a different, e.g., smaller, size than the sheets P in the first storing portion 3*b* may be stored in a second storing portion 30*b*, such that the sheets P1 extend over the bottom plate 30*a* and the plate portion 31*b*. The bottom plate 30*a* and the plate portion 31*b* may function as a sheet placement plate for receiving the sheets P1 thereon. The sheets P1 may be postcards, L size photo paper, or the like.

Figure 9:
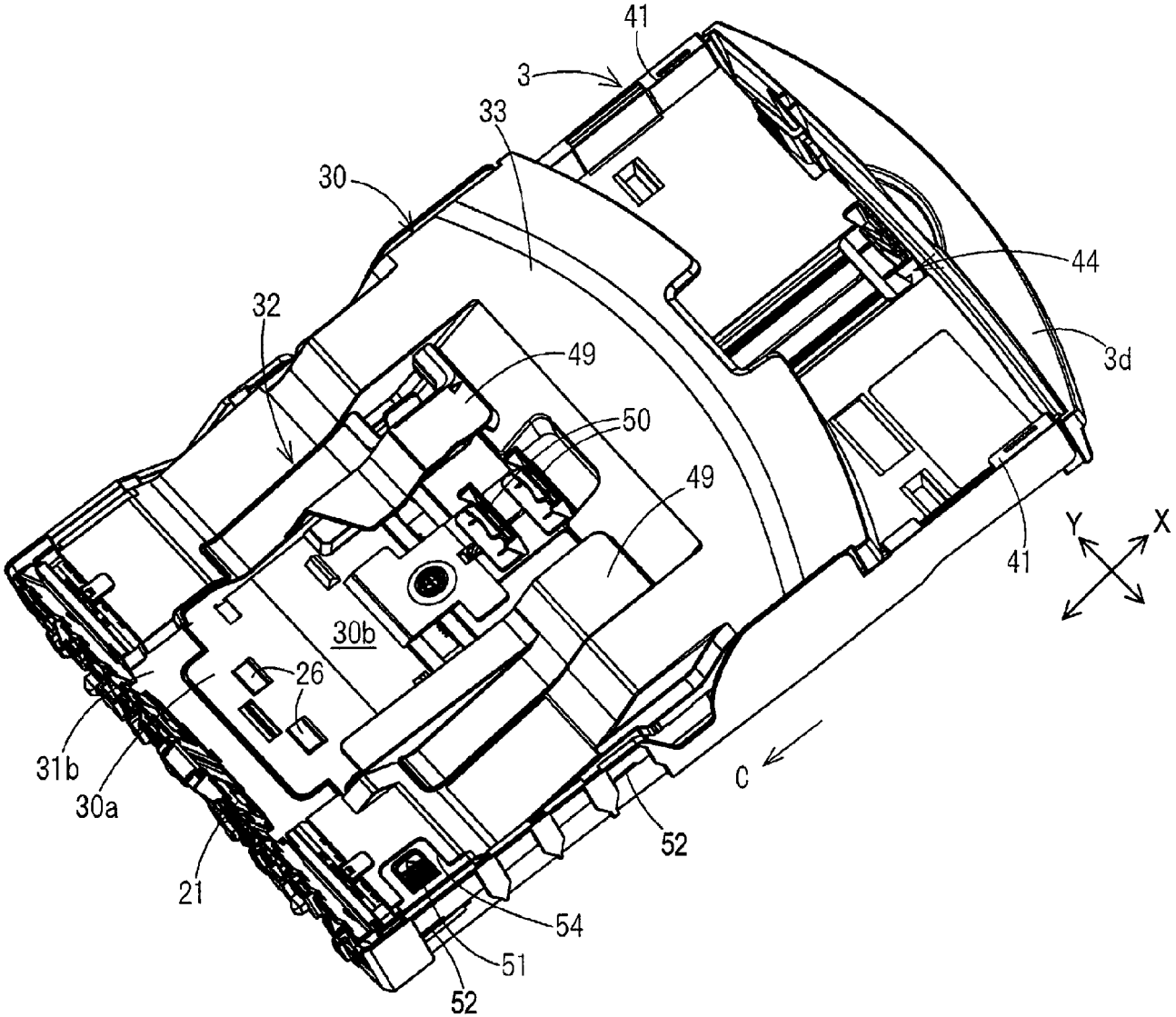
FIG. 9 is a perspective view of the first tray and the second tray when the second tray is in the sheet feed position on the first tray.

The discharged sheet receiver 33 may be integral with the second tray 30 at an upstream portion of the second storing portion 30*b* in the sheet feed direction (at a downstream potion of the second storing portion 30*b* in the sheet discharge direction). As shown in FIGS. 8 and 9, when the second tray 30 moves downstream in the sheet feed direction (indicated arrow C in FIGS. 2 and 9), the sliding portion 31 positioned at an downstream end of the second tray 30 contacts an inner surface of the inclined separation plate 21 of the first tray 3.

In FIG. 3, the second tray 30 is located in the retracted position (non-sheet-feed position) with the sliding portion 31 located at its most upstream position. In FIG. 9, the second tray 30 is located in the sheet feed position with the sliding portion 31 located at its most downstream position.

When the second tray 30 moves into the sheet feed position, the projections 35 engage the grooves 36, such that the second tray 30 may be retained in the sheet feed position without shifting in the Y-axis direction and in the vertical direction. When the sheet feed roller 20*a* applies a force to the sheets in the second tray 30, the second tray 30 may be prevented from bending. Thus, the orientation of the second tray 30 may be maintained parallel with the sheet feed direction of the sheets P1, assuring a stable feeding and separation of the sheets P1.

The feed unit 20 may comprise an arm 20*c* which may be vertically pivotable about a drive shaft 39. The arm 20*a* extends toward the inclined separation plate 21. The feed roller 20*a* may be positioned at a free end of the arm 20*c*, and may be driven by the drive shaft 39 via a gear transmission mechanism (not shown). In this embodiment, as shown in FIG. 3, a pair of feed rollers 20*a* may be positioned symmetrically about a line passing through the Y-axis center.

Figure 4:
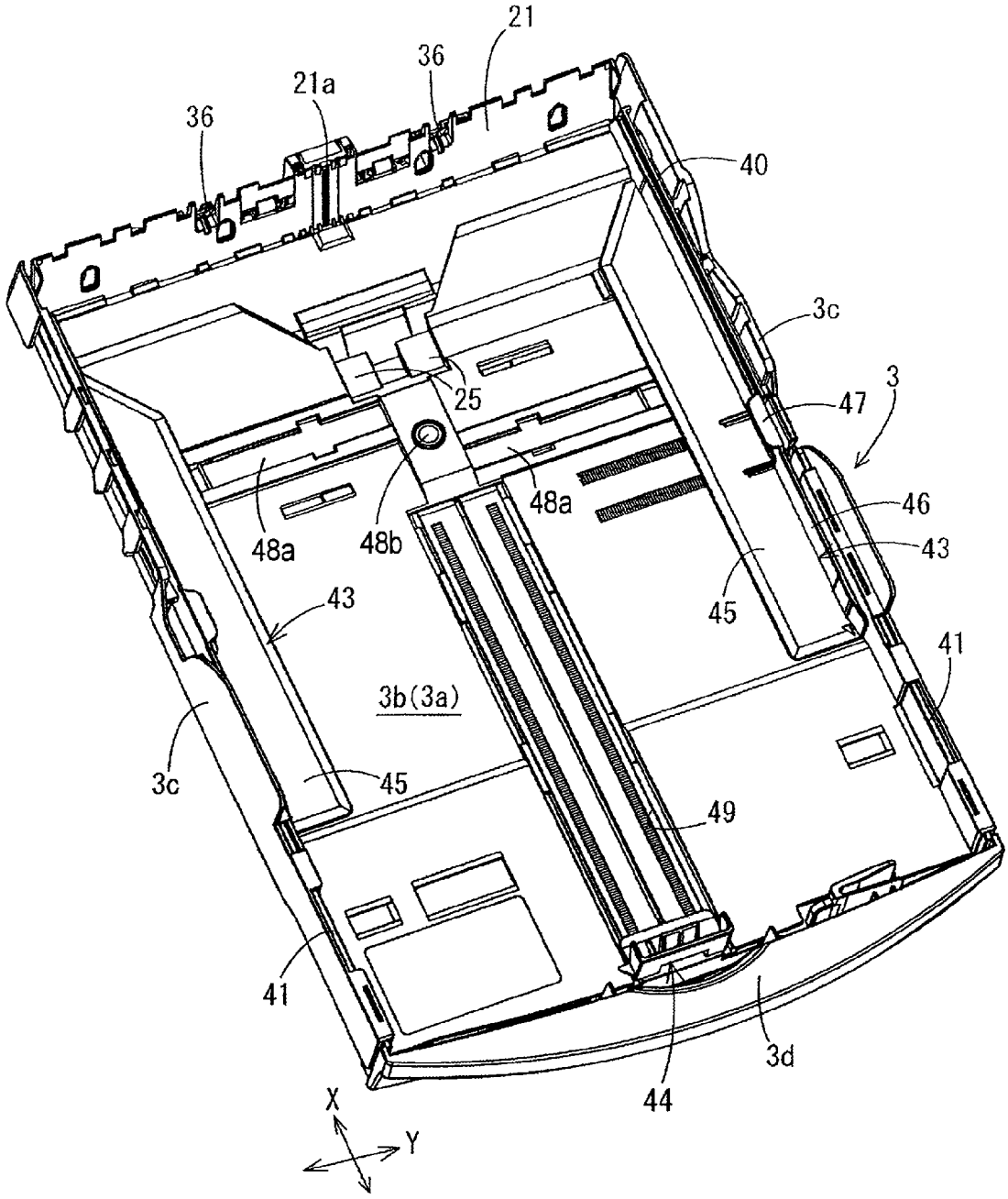
FIG. 4 is a perspective view of a first tray of the sheet feed device of FIG. 2.

As shown in FIGS. 4 and 9, a pair of friction members 25 and 26 may be fixed to an upper surface of the bottom plate 3*a* of the first tray 3 and an upper surface of the bottom plate 30*a* of the second tray 30 (movable portion 32), respectively, to receive the pair of feed rollers 20*a* when the arm 20*c* pivots downward. This prevents two or more sheets from being fed together by the feed rollers 20*a*.

A resilient separation pad 21*a*, which may comprise metal plate springs, may be positioned on an inner surface of the inclined separation plate 21 at a widthwise center (center in the Y-axis direction) of the inclined separation plate 21. The feed rollers 20*a* cooperate with the resilient separation pad 21*a* to separate an uppermost sheet P (P1) from the sheets positioned on the first tray 3 or the second tray 30. The separated sheet P (P1) is fed to the recording unit 10 above the first tray 3 via a conveying path 38, e.g., a U-shaped path. Then, the sheet P (P1) on which an image is recorded by the recording unit 10 is discharged toward the opening 2*a* with the recorded surface facing upward.

As shown in FIGS. 4 and 5, the first storing portion 3*b* of the first tray 3 may comprise a pair of side guides 43 and a tail guide 44. The side guides 43 extend in the sheet feed direction (X-axis direction), and may position and guide side edges of the sheets P positioned in the first storing portion 3*b*. The tail guide 44 positions trailing edges of the sheets P.

The side guides 43 may be slidable, such that the distance therebetween selectively is increased and decreased. Racks 48*a* connected to the side guides 43 may engage a pinion 48*b* positioned at a widthwise center (center in the Y-axis direction) of the first tray 3. Thus, the distance between the side guides 43 may be adjusted, such that a widthwise centerline of the first tray 3 aligns with a widthwise centerline of the sheets P. Each of the side guides 43 may comprise a slider 45 and a stopper. Each slider 45 may be slidable in the Y-axis direction and supports a lower surface of the sheets P. The stopper stands upright, and may contact the side edges of the sheets P.

One of the side guides may comprise a lock member (not shown) with a handle 47. The lock member may be configured to engage one of teeth formed in the upper surface of the bottom plate 3*a*. When the handle is operated, the lock member may be released from the bottom plate 3*a*.

The tail guide 44 may comprise a slider, a stopper, and a lock member with a handle. The slider may be slidable in the sheet feed direction (X-axis direction). The stopper stand upright, and may contact the rear edges of the sheets P. The lock member may be configured to engage one of the teeth formed in the upper surface of the bottom plate 3*a*. When the handle is operated, the lock member may be released.

As shown in FIGS. 3 and 9, the second storing portion 30*b* of the second tray 30 may comprise a pair of side guides 49 and a tail guide 50. The side guides 49 extend in the sheet feed direction (X-axis direction), and may position and guide side edges of the sheets P1 positioned in the second storing portion 30*b*. The tail guide 50 positions trailing edges of the sheets P1.

As shown in FIGS. 3, 5, 7, and 9, a lock mechanism for locking the second tray 30 with respect to the first tray 3 in the sheet feed position (advanced position) or at the non-sheet-feed position (retracted position) may comprise a lock button 51 and two grooves 52. The lock button 51 may be positioned on one side of an upper surface of at least one of the base portions 31*a*. The two grooves 52 may be formed in one of the side plates 3*c* at positions apart from each other in the X-axis direction (FIG. 7 shows a groove 52 used for locking the second tray 30 in the retracted position). The lock button 51 may be configured to slide horizontally with respect to the base portion 31*a* in a width direction of the second tray 30 (Y-axis direction) and may be biased by a spring 53 toward an inner surface of the side plate 3*c*. A latch 51*a* may be integral with an end of the lock button 51. As shown in FIGS. 3 and 9, an opening 54 may be formed in the movable portion 32, such that the lock button 31 is exposed through the opening 54 when the movable potion 32 overlies the base portion 31*a*.

As shown in FIG. 9, when the second tray 30 is in the sheet feed position (advanced position) with respect to the first tray 3, the latch 51*a* the lock button 51 engages a corresponding one of the grooves 52. This prevents the second tray 30 from moving unexpectedly in the X-axis direction during sheet feeding from the second tray 30. In order to move the second tray 30 from the sheet feed position, the user applies a force to the lock button 51 toward the widthwise center of the second tray 30 against the urging force of the spring 53 to release the latch 51 a from the groove 52. Even if the user releases the hand from the lock button 51, the second tray 30 may be moved with the latch 51*a* sliding along the inner surface of the side plate 3*c*. When the second tray 30 moves to the non-sheet-feed position (retracted position), the latch 51*a* automatically engages the other groove 52, thereby restricting the movement of the second tray 30.

In order to feed the sheets P from the first tray 3 having, for example, the maximum capacity of about 150 sheets, the second tray 30 moves to the retracted position, as shown in FIGS. 2 and 3. At this time, the height of the first storing portion 3*b*, i.e., the distances J2 and J4, is great enough that the second tray 30 does not contact the sheets P in the first storing portion 3*b*. In this state, the feed rollers 20*a* contact and apply a force to an uppermost sheet P. When the feed rollers 20*a* rotate clockwise in FIG. 2, the feed rollers 20*a* separate the uppermost sheet P from the other sheets in cooperation with the separation pad 21*a*. The separated sheet P is fed to the recording unit 10 via the conveying path 38.

In order for the feed unit 20 to feed the sheets P1 from the second tray 30, the free end of the movable portion 32 of the second tray 30 located in the retracted position may be pivoted upward to expose the first storing portion 3*b*, as shown in FIG. 5. In this state, excessive sheets may be removed from the first storing portion 3*b*, such that 100 sheets or less remain in the first storing portion 3*b*. Then, the second tray 30 may be moved toward the inclined separation plate 21 of the first tray 3. At this time, the first contact potions 32*a* formed on the lower surface of the movable portion 32 slide on the horizontal first guide rails 41 of the first tray 3, and the second contact portions 31*c* formed on the lower surface of the base portion 31*a* slide on the slanted second guide rails 40 of the first tray 3. When the second tray 30 is in the sheet feed position (advanced position), the height of the first storing portion 3*b* decreases to a height corresponding to the distance J1 at its downstream end. Thus, the height of the bottom plate 30*a* with respect to the bottom plate 3*a* is less when the second tray 30 is in the sheet feed position than when the second tray 30 is in the retracted position.

As such, the capacity of the first tray 3 may be increased without decreasing the sheet drawing force of the feed roller 20*a*. These advantages may be obtained without changing the mounting height of the feed unit 20. Consequently, the height of the image recording apparatus 1 does not increase.

Figure 10:
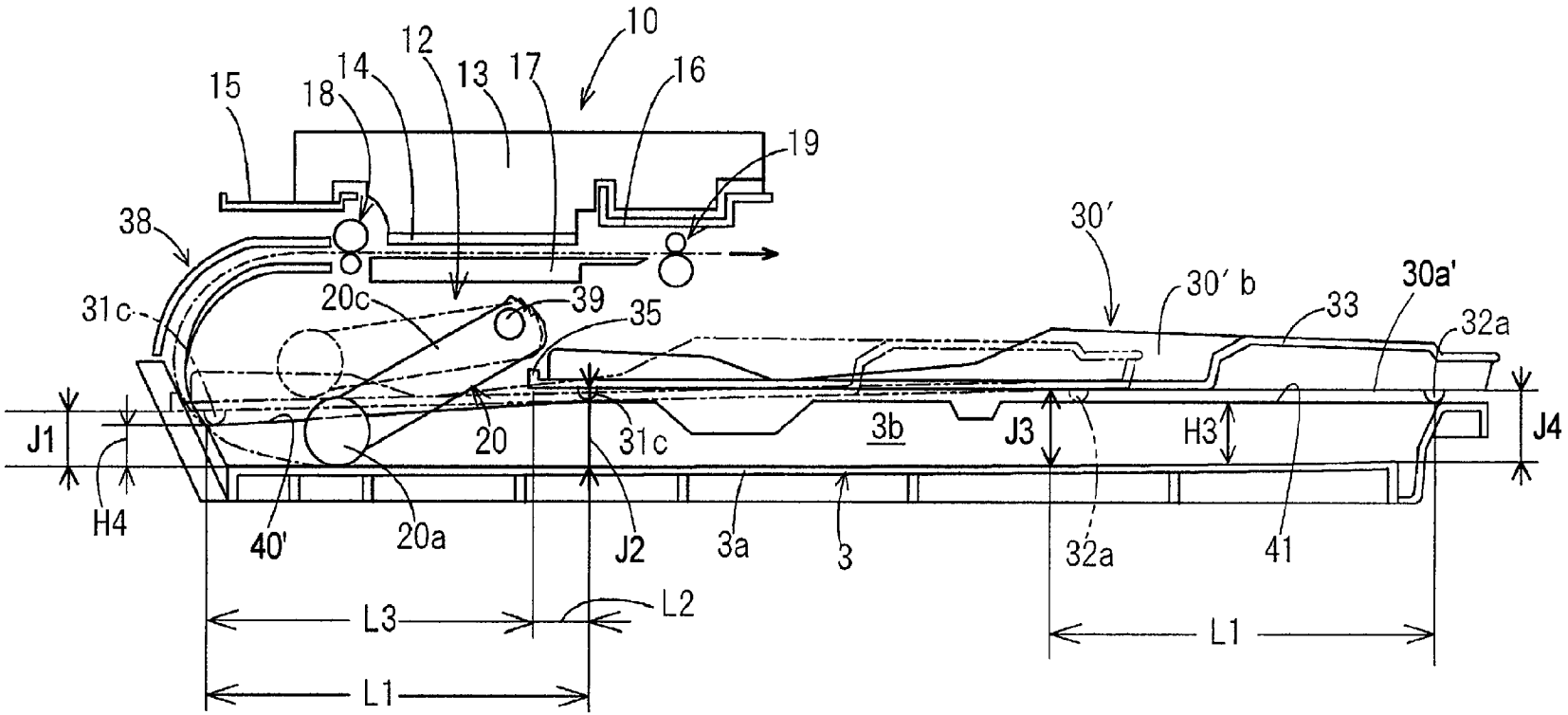
FIG. 10 is a side, cross-sectional view of a sheet feed device, according to another embodiment of the present invention.

Referring to FIG. 10, a sheet feed device according to another embodiment of the present invention is depicted. The sheet feed device of this embodiment of the present invention may be substantially similar to the sheet feed device of the above-described embodiments of the present invention. Therefore, only those differences between this embodiment of the present invention and the above-described embodiments of the present invention are discussed with respect to this embodiment of the present invention. Referring to FIG. 10, a second tray 30' may be different than the second tray 30. For example, the second tray 30' may be a single body and may not be separated into the sliding portion 31 and the movable portion 32. A first contact portion 32*a* and a second contact portion 31*c* may be formed on a lower surface of each of opposed sides of the second tray 30'. The first contact portion 32*a* may be formed at an upstream side, and the second contact portion 31*c* may be formed at a downstream side in the sheet feed direction. A pair of projections 35 may be formed at a downstream end of the second tray 30'.

A first guide rail 41 for supporting the first contact portion 32*a* and a second guide rail 40' for supporting the second contact portion 31*c* may be formed on each of opposed side plates of a first tray 3. The first guide rail 41 may be integral with an upper surface of each of the opposed side plates. The second guide rail 40' may be integral with an inner surface of each of the opposed side plates. The upper surface of the first guide rail 41 may be substantially parallel with the bottom plate 3*a*, and a height H3 from the bottom plate 3*a* to the upper surface of the first guide rail 41 may not be altered. The second guide rail 40' may have a horizontal upper surface over a length L2, and a slanted upper surface over a length L3, which extends downstream of the length L2. A height from the bottom plate 3*a* to the horizontal upper surface of the second guide rail 40' may be equal to the height H3. The horizontal upper surface of the second guide rail 40' receives the second contact portion 31*c* of the second tray 30' located in the retracted position. A height H4 from the bottom plate 3*a* to the upper surface of the downstream end of the second guide rail 40' may be less than the height H3.

The length along which the second guide rail 40' extends in the sheet feed direction corresponds to a length L1, e.g., about 90 mm, along which the second tray 30' moves between the sheet feed position and the retracted position. When the second tray 30' is in the sheet feed position, a downstream end of the second tray 30' in the sheet feed direction may be positioned closest to the inclined separation plate 21 of the first tray 3. When the second tray 30' is in the retracted position, the downstream end of the second tray 30' may be retracted upstream from the sheet feed roller 20*a*. The length along which the first guide rail 41 extends also may correspond to the length Ll. The side plate 3*c* may connect an upstream end of the second guide rail 40' and a downstream end of the first guide rail 41.

In FIG. 10, distances J1 and J3 indicate distances from the upper surface of the bottom plate 3*a* to the lower surface of the bottom plate 30'*a* measured at the downstream end of the second guide rail 40' and the downstream end of the first guide rail 41, respectively, when the second tray 30' is in the sheet feed position. Distances J2 and J4 indicate distances from the upper surface of the bottom plate 3*a* to the lower surface of the bottom plate 30'*a* measured at the upstream end of the second guide rail 40' and the upstream end of the first guide rail 41, respectively, when the second tray 30' is in the retracted position. Similarly to the above-described embodiments of the present invention, the distance J1 may be less than the distance J2, the distance J2 may be equal to the distance J4, and the distance J3 may be equal to the distance J4. As such, the shortest distance from the upper surface of the bottom plate 3*a* to the lower surface of the bottom plate 30'*a* may be less when the second tray 30' is in the sheet feed position than the shortest distance from the upper surface of the bottom plate 3*a* to the lower surface of the bottom plate 30'*a* when in the retracted position.

When the second tray 30' is in the retracted position, the sheets P may be fed from the first tray 3, which may have a maximum capacity of about 150 sheets. In order for the feed unit 20 to feed the sheets from the second tray 30', the second tray 30' may be advanced to the sheet feed position after reducing the number of sheets P, e.g., to about 100 sheets or less. Because the second tray 30' may be lowered when it is in the sheet feed position, the drawing force of the feed rollers 20*a* for the sheets stored in the second storing portion 30'*b* may be maintained.

Figure 11:
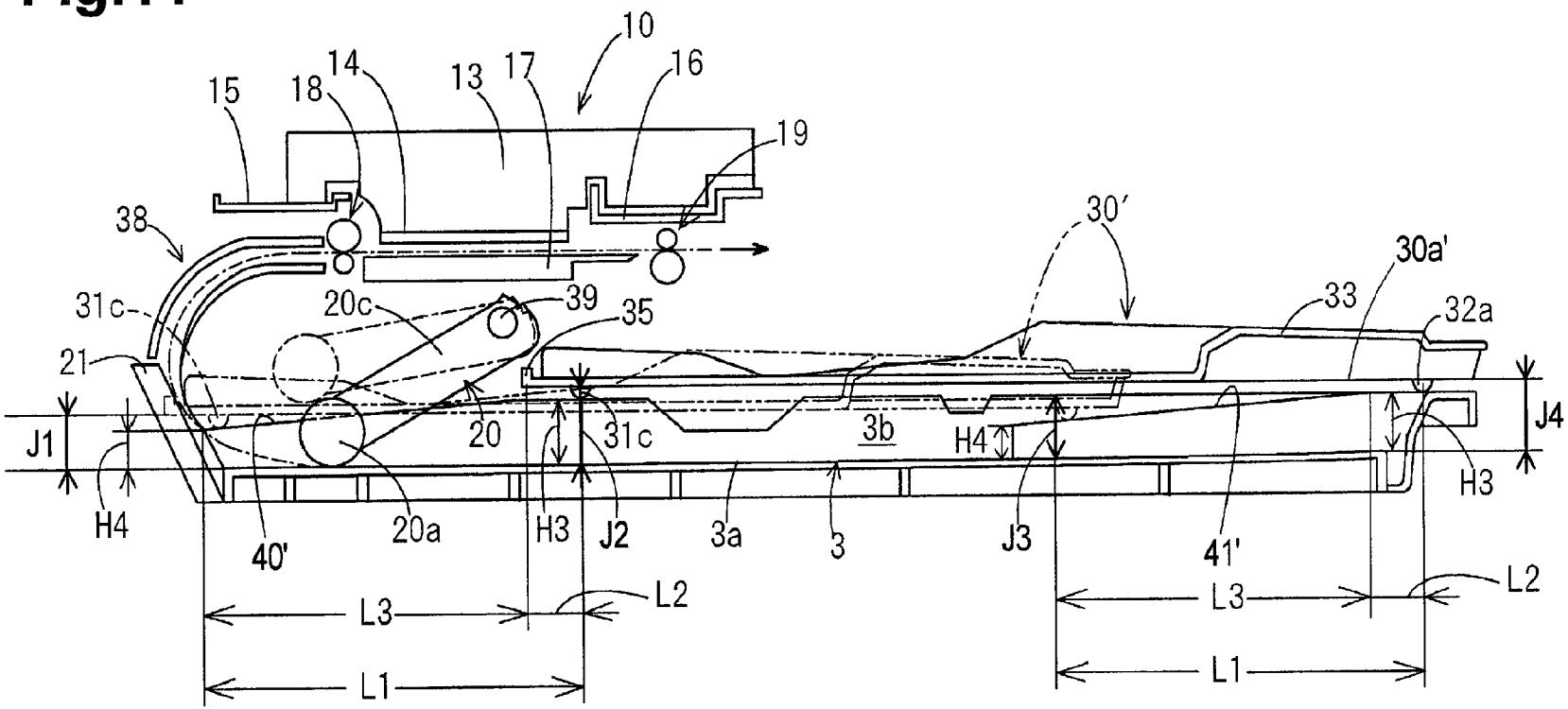
FIG. 11 is a side, cross-sectional view of a sheet feed device, according to yet another embodiment of the present invention.

Referring to FIG. 11, a sheet feed device according to yet another embodiment of the present invention is depicted. The sheet feed device of this embodiment of the present invention may be substantially similar to the sheet feed device of the above-described embodiments of the present invention. Therefore, only those differences between this embodiment of the present invention and the above-described embodiments of the present invention are discussed with respect to this embodiment of the present invention. Referring to FIG. 11, the sheet feed device may comprise the second tray 30' and the second guide rail 40' Moreover, similar to the guide rail 40', a first guide rail 41' may have a horizontal upper surface over a length L2, and a slanted upper surface over a length L3 which extends downstream of the length L2. The horizontal upper surface of the second guide rail 40' and the horizontal upper surface of the first guide rail 41' receive, at a height H3, the first contact portion 32*a* and the second contact portion 31*c*, respectively, of the second tray 30' located in the retracted position. A height H4 from the bottom plate 3*a* to the upper surface of the downstream end of the second guide rail 40' may be equal to a height from the bottom plate 3*a* to the downstream end of the first guide rail 41', and may be less than the height H3.

The slanted upper surface of the second guide rail 40' may be parallel with the slanted upper surface of the first guide rail 41'. In this case, the second tray 30' may be in horizontal orientation when in the retracted position, when in the sheet feed position, and when advancing toward the sheet feed position.

In FIG. 11, distances J1 and J3 indicate distances from the upper surface of the bottom plate 3*a* to the lower surface of the bottom plate 30'*a* measured at the downstream end of the second guide rail 40' and the downstream end of the first guide rail 41', respectively, when the second tray 30' is in the sheet feed position. Distances J2 and J4 indicate distances from the upper surface of the bottom plate 3*a* to the lower surface of the bottom plate 30'*a* measured at the upstream end of the second guide rail 40' and the upstream end of the first guide rail 41', respectively, when the second tray 30' is in the retracted position. In this embodiment, the distance J1 may be less than the distance J2, the distance J2 may be equal to the distance J4, and the distance J3 may be less than the distance J4 and equal to the distance J1. As such, the shortest distance from the upper surface of the bottom plate 3*a* to the lower surface of the bottom plate 30'*a* when the second tray 30' is in the sheet feed position may be less than the shortest distance from the upper surface of the bottom plate 3*a* to the lower surface of the bottom plate 30'*a* when the second tray 30' is when in the retracted position.

In still yet another embodiment of the present invention, instead of the first guide rail 41, 41' and the second guide rail 4', the first tray 3 may have, at each of its opposed side plates, a pair of first support portions that support the first contact portion 32*a* and the second contact portion 31*c*, respectively, of the second tray 30' located in the retracted position, and a pair of second support portions that support the first contact portion 32*a* and the second contact portion 31*c*, respectively, of the second tray 30' located in the sheet feed position. The first support portions may be higher than the second support portions with respect to the bottom plate 3*a*.

In order to move the second tray 30' from the retracted position to the sheet feed position, the second tray 30' may be lifted from the first support portions, and may be positioned onto the second support portions. The second tray 30' may be supported in a horizontal orientation both at a higher position (by the first support portions) and at a lower position (by the second support portions), or may be supported at the lower position (by the second support portions) with its downstream end slanted downward.

In the above-described embodiments of the present invention, the first contact portion and the second contact portion may project from the lower surface of each side of the second tray, and may reduce the sliding resistance against the first guide rail and the second guide rail. Nevertheless, flat surface portions of the lower surface of the second tray may contact the first guide rail (upstream supports) and the second guide rail (downstream supports).

While the invention has been described in connection with preferred embodiments, it will be understood by those of ordinary skill in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples only are considered as exemplary of the invention, with the true scope of the invention being defined by the following claims.

What is claimed is:

1. A sheet feed device comprising:

a first tray comprising a first plate configured to receive a first plurality of sheets thereon, wherein the first tray comprises a support;

a second tray positioned on the first tray, wherein the second tray comprises a first side portion, a second side portion which opposes the first side portion, and a second plate configured to receive a second plurality of sheets thereon; and a feed roller configured to selectively feed the first plurality of sheets and the second plurality of sheets in a sheet feed direction toward a sheet feed path, wherein the first side portion and the second side portion extend along the sheet feed direction, and the support is configured to support the first side portion and the second side portion, wherein the support is further configured to selectively support the second tray in a retracted position in which the feed roller is configured to selectively feed the first plurality of sheets and in a sheet feed position in which the feed roller is configured to selectively feed the second plurality of sheets, wherein a shortest distance between an upper surface of the first plate and a lower surface of the second plate when the second tray is in the sheet feed position is less than a shortest distance between the upper surface of the first plate and the lower surface of the second plate when the second tray is in the retracted position, wherein the first tray comprises a third side portion and a fourth side portion which opposes the third side portion, and the third side portion and the fourth side portion extend along the sheet feed direction, wherein the first side portion comprises a first contact portion and a second contact portion at a lower surface thereof, and the second side portion comprises a third contact portion and a fourth contact portion at a lower surface thereof, wherein the support comprises a first support portion configured to support the first contact portion, a second support portion configured to support the second contact portion, a third support portion configured to support the third contact portion, a fourth support portion configured to support the fourth contact portion, and wherein the first support portion comprises a first upstream portion for supporting the first contact portion when the second tray is in the retracted position, and a first downstream portion for supporting the first contact portion when the second tray is in the sheet feed position, wherein the second support portion comprises a second upstream portion for supporting the second contact portion when the second tray is in the retracted position, and a second downstream portion for supporting the second contact portion when the second tray is in the sheet feed position, wherein the third support portion comprises a third upstream portion for supporting the third contact portion when the second tray is in the retracted position, and a third downstream portion for supporting the third contact portion when the second tray is in the sheet feed position, wherein the fourth support portion comprises a fourth upstream portion for supporting the fourth contact portion when the second tray is in the retracted position, and a fourth downstream portion for supporting the fourth contact portion when the second tray is in the sheet feed position.

2. The sheet feed device of claim 1, wherein the support is formed on the third side portion and the fourth side portion.

3. The sheet feed device of claim 1, wherein the first contact portion and the third contact portion are positioned at an upstream side in the sheet feed direction, and the second contact portion and the fourth contact portion are positioned at a downstream side in the sheet feed direction, wherein the first contact portion, the second contact portion, the third contact portion, and the fourth contact portion are configured to contact an upper surface of the support.

4. The sheet feed device of claim 1, wherein the support comprises a support portion on which the first side portion and the second side portion are supported when the second tray moves between the retracted position and the sheet feed position, and the support portion has a height which continuously is altered with respect to the upper surface of the first plate.

5. The sheet feed device of claim 3, wherein the first support portion and the second support portion are positioned at the third side portion, and the third support portion and the fourth support portion are positioned at the fourth side portion.

6. The sheet feed device of claim 1, wherein a distance at the second downstream portion between the upper surface of the first plate and the lower surface of the second plate when the second tray is in the sheet feed position is less than a distance at the second upstream portion between the upper surface of the first plate and the lower surface of the second plate when the second tray is in the retracted position, wherein a distance at the fourth downstream portion between the upper surface of the first plate and the lower surface of the second plate when the second tray is in the sheet feed position is less than a distance at the fourth upstream portion between the upper surface of the first plate and the lower surface of the second plate when the second tray is in the retracted position.

7. The sheet feed device of claim 1, wherein the first upstream portion and the first downstream portion are continuous and define therebetween a first upper surface on which the first contact portion slides when the second tray moves between the retracted position and the sheet feed position, and the second upstream portion and the second downstream portion are continuous and define therebetween a second upper surface on which the second contact portion slides when the second tray moves between the retracted position and the sheet feed position, wherein the third upstream portion and the third downstream portion are continuous and define therebetween a third upper surface on which the third contact portion slides when the second tray moves between the retracted position and the sheet feed position, and the fourth upstream portion and the fourth downstream portion are continuous and define therebetween a fourth upper surface on which the fourth contact portion slides when the second tray moves between the retracted position and the sheet feed position.

8. The sheet feed device of claim 7, wherein the first upper surface and the third upper surface are substantially parallel with the first plate, and at least a portion of the second upper surface and at least a portion of the fourth upper surface are slanted with respect to the first plate.

9. The sheet feed device of claim 7, wherein at least a portion of the first upper surface, at least a portion of the second upper surface, at least a portion of the third upper surface, and at least a portion of the fourth upper surface are slanted with respect to the first plate.

10. The sheet feed device of claim 1, wherein the first tray further comprises an auxiliary support configured to support a downstream end of the second tray in the sheet feed direction when the second tray is in the sheet feed position.

11. The sheet feed device of claim 10, wherein the second tray further comprises a projection extending from the downstream end of the second tray, and the first tray further comprises a separation plate which is positioned at a downstream end of the first tray in the sheet feed direction and is configured to selectively separate an uppermost sheet of the first plurality of sheets and an uppermost sheet of the second plurality of sheets in cooperation with the feed roller, wherein the separation plate has a groove formed therein, and the groove is configured to receive the projection when the second tray is in the sheet feed position.

12. The sheet feed device of claim 1, wherein the first tray further comprises a third side portion and a fourth side portion which opposes the third side portion, and the third side portion and the fourth side portion extend along the sheet feed direction, wherein the second tray further comprises a sliding portion and a movable portion pivotably connected to the sliding portion, and the sliding portion is positioned downstream of the movable portion in the sheet feed direction, wherein the sliding portion and the movable portion extend over the third side portion and the fourth side portion, and the sliding portion and the movable portion are slidably supported by the support.

13. The sheet feed device of claim 1, wherein the feed roller is connected to a free end of a pivotable arm, and the feed roller contacts an uppermost one of the first plurality of sheets when the second tray is in the retracted position which is upstream from the feed roller in the sheet feed direction, and the feed roller contacts an uppermost one of the second plurality of sheets when the second tray is in the sheet feed position.

14. The sheet feed device of claim 1, wherein a size of the first plurality of sheets is different than a size of the second plurality of sheets.

15. An image recording apparatus comprising:

a sheet feed device comprising a first tray comprising a first plate configured to receive a first plurality of sheets thereon, wherein the first tray comprises a support;

a second tray positioned on the first tray, wherein the second tray comprises a first side portion, a second side portion which opposes the first side portion, and a second plate configured to receive a second plurality of sheets thereon; and a feed roller configured to selectively feed the first plurality of sheets and the second plurality of sheets in a sheet feed direction toward a sheet feed path, wherein the first side portion and the second side portion extend along the sheet feed direction, and the support is configured to support the first side portion and the second side portion, wherein the support is further configured to selectively support the second tray in a retracted position in which the feed roller is configured to selectively feed the first plurality of sheets and in a sheet feed position in which the feed roller is configured to selectively feed the second plurality of sheets, wherein a shortest distance between an upper surface of the first plate and a lower surface of the second plate when the second tray is in the sheet feed position is less than a shortest distance between the upper surface of the first plate and the lower surface of the second plate when the second tray is in the retracted position;

a housing; and a recording unit configured to receive the first plurality of sheets and the second plurality of sheets from the feed roller via the sheet feed path, and to record an image on the first plurality of sheets and the second plurality of sheets received from the feed roller, wherein the recording unit and the sheet feed device are positioned within the housing, the sheet feed path is formed in the housing, and the first tray and the second tray are configured to be selectively inserted into and removed from the housing, wherein the first tray comprises a third side portion and a fourth side portion which opposes the third side portion, and the third side portion and the fourth side portion extend along the sheet feed direction, wherein the first side portion comprises a first contact portion and a second contact portion at a lower surface thereof, and the second side portion comprises a third contact portion and a fourth contact portion at a lower surface thereof, wherein the support comprises a first support portion configured to support the first contact portion, a second support portion configured to support the second contact portion, a third support portion configured to support the third contact portion, a fourth support portion configured to support the fourth contact portion, and wherein the first support portion comprises a first upstream portion for supporting the first contact portion when the second tray is in the retracted position, and a first downstream portion for supporting the first contact portion when the second tray is in the sheet feed position, wherein the second support portion comprises a second upstream portion for supporting the second contact portion when the second tray is in the retracted position, and a second downstream portion for supporting the second contact portion when the second tray is in the sheet feed position, wherein the third support portion comprises a third upstream portion for supporting the third contact portion when the second tray is in the retracted position, and a third downstream portion for supporting the third contact portion when the second tray is in the sheet feed position, wherein the fourth support portion comprises a fourth upstream portion for supporting the fourth contact portion when the second tray is in the retracted position, and a fourth downstream portion for supporting the fourth contact portion when the second tray is in the sheet feed position.

* * * * *